US006532977B2

(12) United States Patent
Otsuki et al.

(10) Patent No.: US 6,532,977 B2
(45) Date of Patent: Mar. 18, 2003

(54) CLEANING VESSEL AND SILICON CARBIDE SINTERED BODY USED THEREFOR

(75) Inventors: Masashi Otsuki, Musashimurayama (JP); Shigeki Endo, Tokorozawa (JP); Yuka Murakawa, Kita-ku (JP)

(73) Assignee: Bridgestone Corporation, Tokyo (JP)

( * ) Notice: Subject to any disclaimer, the term of this patent is extended or adjusted under 35 U.S.C. 154(b) by 43 days.

(21) Appl. No.: 09/785,195

(22) Filed: Feb. 20, 2001

(65) Prior Publication Data

US 2001/0024704 A1 Sep. 27, 2001

(30) Foreign Application Priority Data

Mar. 16, 2000 (JP) ..... 2000-074085
Jun. 1, 2000 (JP) ..... 2000-164876

(51) Int. Cl.[7] ..... B08B 3/12
(52) U.S. Cl. ..... 134/184
(58) Field of Search ..... 134/184, 186, 134/1, 13

(56) References Cited

U.S. PATENT DOCUMENTS 5,119,840 A * 6/1992 Shibata ..... 134/184
5,533,540 A * 7/1996 Stanasolovich et al. . 134/184 X
5,911,232 A * 6/1999 Mokuo et al. ..... 134/184
6,026,832 A * 2/2000 sato et al. ..... 134/184
6,138,698 A * 10/2000 Tanaka et al. ..... 134/184

* cited by examiner

*Primary Examiner*—Philip Coe
(74) *Attorney, Agent, or Firm*—Oliff & Berridge, PLC

(57) ABSTRACT

A long-lived cleaning vessel for ultrasonic cleaning is provided which is easily manufactured and is also easy to handle due to a simple structure thereof, and has excellent durability, mechanical strength, and corrosion resistance. A cleaning vessel 1 of the present invention includes a layer of silicon carbide sintered body 3 which propagates ultrasonic waves. Further, a silicon carbide sintered body is provided which can be applied to components for semiconductor production apparatuses, components for electronic information equipment, and various structural components for vacuum devices and the like, and which can particularly suitably be used as an ultrasonic resonance plate or an ultrasonic diaphragm, and can be easily processed, and further which can be made thinner while maintaining sufficient mechanical strength. The silicon carbide sintered body can propagate ultrasonic waves and an acoustic velocity of ultrasonic waves propagated therethrough is 4000 to 20000 m/s.

12 Claims, 3 Drawing Sheets

PRIOR ART

CLEANING VESSEL AND SILICON CARBIDE SINTERED BODY USED THEREFOR

BACKGROUND OF THE INVENTION

1. Field of the Invention

The present invention relates to a long-lived cleaning vessel for ultrasonic cleaning, which is easily manufactured and is also easy to handle due to a simple structure thereof and which has excellent durability, mechanical strength, and resistance to corrosion. Further, the present invention also relates to a silicon carbide sintered body which propagates ultrasonic waves, and particularly to a silicon carbide sintered body of high density and high purity, which can be applied to components for semiconductor production apparatuses, components for electronic information equipment, and various structural components for vacuum devices and the like, and which can suitably be used as an ultrasonic resonance plate or an ultrasonic diaphragm.

2. Description of the Related Art

Conventionally, ultrasonic cleaning which allows cleaning of materials to be cleaned by means of ultrasonic waves, has been carried out in various fields. In the above-described ultrasonic cleaning, a material to be cleaned is immersed in a cleaning liquid accommodated in a cleaning vessel. An ultrasonic oscillator disposed at the bottom of the cleaning vessel is oscillated at a predetermined frequency. As a result, ultrasonic vibration is induced in the cleaning liquid, and impurities such as oil or dust, which adhere to the surface of the material to be cleaned, and to the vicinity thereof, are removed due to cavitation of the cleaning liquid.

As the cleaning vessel used for the above-described ultrasonic cleaning, conventionally, for example, a cleaning vessel 10 as shown in FIG. 3 has been known. The cleaning vessel 10 includes an outer cleaning vessel 12 made of metal, resin, or the like, and an inner cleaning vessel 11 disposed to be accommodated in an interior of the outer cleaning vessel 12. An ultrasonic propagation medium 13 is accommodated in a clearance formed between the outer cleaning vessel 12 and the inner cleaning vessel 11, and an ultrasonic oscillator 5 is disposed at the bottom of the outer cleaning vessel 12. It is advantageous to use, as the cleaning liquid, a liquid such as acid, having a strong corrosiveness, from the standpoint of improving cleaning efficiency of the material to be cleaned. Therefore, conventionally, the inner cleaning vessel 11 has been generally made of quartz in a case of acid cleaning.

However, the inner cleaning vessel 11 made of quartz or the like has a problem in that it is apt to be deteriorated and broken by ultrasonic waves and durability thereof deteriorates, and particularly, such defects are remarkably caused in a peripheral edge portion at the bottom of the vessel. Further, there exists a problem in that propagation of ultrasonic waves is interfered and cleaning efficiency thereby deteriorates. Moreover, there also exists a problem in that sufficient corrosion-resistance to hydracid fluoride is not obtained and the vessel cannot be used when hydrofluoric acid or mixture of hydrofluoric acid and nitric acid, which is used very often for cleaning of semiconductor materials, is used as the cleaning liquid.

Furthermore, in the fields of semiconductors and ultrasonic vibration, quartz components which have been conventionally used, deteriorate or degenerate due to cleaning using chemicals such as hydrofluoric acid. Therefore, there has recently been remarked a high density silicon carbide sintered body having excellent resistance to heat, in which the above-described problems are not caused. Particularly, in the field of ultrasonic vibration, it is necessary that a silicon carbide sintered body propagates ultrasonic waves. Desirably, a sound velocity of propagated ultrasonic waves may be increased.

SUMMARY OF THE INVENTION

An object of the present invention is to solve the above-described conventional problems and achieve the following object. That is, an object of the present invention is to provide a long-lived cleaning vessel used for ultrasonic cleaning, which is easily manufactured and is also easy to handle due to a simple structure thereof and which has excellent durability, mechanical strength, and resistance to corrosion.

As a result of their diligent studies for solving the above-described problems, the present inventors noted that ultrasonic waves contacting a material to be cleaned, which is accommodated within a cleaning vessel, are apt to be reflected and propagated through a peripheral edge at the bottom of the cleaning vessel, the peripheral edge at the bottom of the cleaning vessel is apt to be broken due to the ultrasonic waves, and a portion in which the ultrasonic waves are introduced, is also apt to be broken due to the ultrasonic waves.

The present invention has been devised based on the above-described extended researches of the present inventors, and the above-described problem is solved by the following means.

In accordance with a first aspect of the present invention, there is provided a cleaning vessel for cleaning a material to be cleaned, by introducing therein ultrasonic waves, the cleaning vessel comprising a cleaning vessel main body in which the material to be cleaned is accommodated together with a cleaning liquid, and a layer of silicon carbide sintered body which propagates ultrasonic waves, wherein the layer of silicon carbide sintered body is formed at an inner side of the cleaning vessel main body at least on a bottom peripheral edge portion of the cleaning vessel main body and on a portion in which the ultrasonic waves are introduced.

In accordance with a second aspect of the present invention, the layer of silicon carbide sintered body is comprised of a silicon carbide sintered body of which density is 2.9 g/cm$^3$ or greater.

In accordance with a third aspect of the present invention, the layer of silicon carbide sintered body is comprised of a silicon carbide sintered body in which the total content of elements other than Si, C, O, N, halogen, and rare gas is 10 ppm or less.

In accordance with a fourth aspect of the present invention, the layer of silicon carbide sintered body is comprised of a silicon carbide sintered body of which volume resistivity is 1 Ω·cm or less.

In accordance with a fifth aspect of the present invention, the layer of silicon carbide sintered body is comprised of a silicon carbide sintered body which can be heated by turning on electricity.

In accordance with a sixth aspect of the present invention, the layer of silicon carbide sintered body formed on the bottom peripheral edge portion at the inner side of the cleaning vessel main body, has a passage for a cooling medium.

In accordance with a seventh aspect of the present invention, providing that a wavelength of introduced ultrasonic waves is λ, an acoustic velocity of the ultrasonic waves is υ, and a frequency of the ultrasonic waves is f, thickness (b) of the layer of silicon carbide sintered body when oscillated a wavelength l/m, is represented by the following expression:

$$b=(\lambda/m)n=(\upsilon/mf)n$$

(n represents an integer).

In accordance with an eighth aspect of the present invention, the layer of silicon carbide sintered body is formed on an entire surface at an inner side of the cleaning vessel main body.

In accordance with a ninth aspect of the present invention, the cleaning vessel main body has a heat resisting temperature of 120° C. or higher.

In accordance with a tenth aspect of the present invention, the cleaning vessel main body has high chemical resistance.

In accordance with an eleventh aspect of the present invention, the cleaning vessel main body is made of thermosetting resin.

In accordance with a twelfth aspect of the present invention, the thermosetting resin is any one of polyvinyl chloride and polytetrafluoroethylene.

According to the first aspect, the cleaning vessel is comprised of the cleaning vessel main body in which the material to be cleaned is accommodated together with the cleaning liquid, and the layer of silicon carbide sintered body. When ultrasonic waves are oscillated from an outer side to an inner side of the cleaning vessel, the ultrasonic waves propagate through the cleaning vessel main body and are introduced into the cleaning vessel main body. At this time, the layer of silicon carbide sintered body is formed at the inner side of the cleaning vessel main body at least on the bottom peripheral edge portion and on a portion in which the ultrasonic waves are introduced. The layer of silicon carbide sintered body propagates ultrasonic waves, and therefore, the ultrasonic waves are propagated into the cleaning vessel irrespective of the presence of the layer of silicon carbide sintered body. For this reason, when the material to be cleaned is accommodated together with the cleaning liquid in the cleaning vessel main body, ultrasonic waves introduced into the inner side of the cleaning vessel main body, propagate the cleaning liquid (that is, ultrasonic vibration is induced in the cleaning liquid), and contact the material to be cleaned. At this time, impurities such as oil or dust, which adhere to the surface of the material to be cleaned, and to the vicinity thereof, are removed due to a vibration action (cavitation) of the cleaning liquid, and ultrasonic cleaning of the material to be cleaned is carried out.

In the ultrasonic cleaning, even if the ultrasonic waves contacting the material to be cleaned, concentrate on the bottom peripheral edge portion of the cleaning vessel main body, the layer of silicon carbide sintered body having high hardness, durability, and strength is formed on the bottom peripheral edge portion, thereby causing no breakage or the like on the bottom peripheral edge portion. Further, the layer of silicon carbide sintered body having high hardness, durability, strength, and chemical resistance is formed on a portion of the cleaning vessel main body in which the ultrasonic waves are introduced. Therefore, no breakage or the like is caused in the portion influenced by a great shock of ultrasonic waves.

In the above-described cleaning vessel, the layer of silicon carbide sintered body is merely formed at the inner side of the cleaning vessel main body. Therefore, the cleaning vessel is easily manufactured and is easy to handle due to a simple structure thereof.

According to the second aspect, in the cleaning vessel, the layer of silicon carbide sintered body is comprised of a silicon carbide sintered body of which density is 2.9 g/cm$^3$ or more. The layer of silicon carbide sintered body has excellent durability and mechanical strength. Accordingly, in the above-described cleaning vessel, deterioration, breakage, or the like thereof caused by ultrasonic waves are effectively prevented.

According to the third aspect, in the cleaning vessel, the layer of silicon carbide sintered body is comprised of a silicon carbide sintered body in which the total content of elements other than Si, C, O, N, halogen, and rare gas is 10 ppm or less. Accordingly, when ultrasonic cleaning is carried out using the cleaning vessel, there is a reduced risk of the material to be cleaned being contaminated by these elements, that is, impurities, which are dissolved into the cleaning liquid to contaminate the cleaning liquid.

According to the fourth aspect, in the cleaning vessel, the layer of silicon carbide sintered body is comprised of a silicon carbide sintered body of which volume resistivity is 1 Ω·cm or less. Accordingly, the layer of silicon carbide sintered body is easily subjected to processing such as electric discharge machining. Further, static electricity is eliminated, and charging is not easy to occur in the silicon carbide sintered body. As a result, in this cleaning vessel, adhesion of particles caused by charging is effectively prevented.

According to the fifth aspect, in the cleaning vessel, the layer of silicon carbide sintered body is comprised of a silicon carbide sintered body which can be heated by turning on electricity. Accordingly, the cleaning vessel is heated when the layer of silicon carbide sintered body is charged with electricity. The above-described cleaning vessel heated to a fixed temperature is easy to introduce the ultrasonic waves therein, and is thereby excellent in the ultrasonic cleaning efficiency.

According to the sixth aspect, in the cleaning vessel, the layer of silicon carbide sintered body formed on the bottom peripheral edge portion at the inner side of the cleaning vessel main body, has a passage for a cooling medium. For this reason, when the silicon carbide sintered body or the cleaning vessel is in an overheat state, the silicon carbide sintered body or the cleaning vessel is cooled only by flowing a cooling medium through the passage for a cooling medium. As a result, overheat of the cleaning liquid accommodated in the cleaning vessel main body is effectively restrained.

According to the seventh aspect, in the cleaning vessel, providing that a wavelength of introduced ultrasonic waves is λ, an acoustic velocity of the ultrasonic waves is υ, and a frequency of the ultrasonic waves is f, thickness b of the layer of silicon carbide sintered body when oscillated a wavelength l/m, is represented by the following expression:

$$b=(\lambda/m)n=(\upsilon/mf)n$$

(n represents an integer).

The layer of silicon carbide sintered body in the cleaning vessel resonates with the introduced ultrasonic waves a half-wave length, and the ultrasonic waves are transmitted therethrough without being reflected. For this reason, ultrasonic waves introduced into the cleaning vessel, contact the material to be cleaned, without being interfered. As a result, the cleaning vessel is extremely excellent in the ultrasonic cleaning efficiency.

According to the eighth aspect, in the cleaning vessel, the layer of silicon carbide sintered body is formed on the entire surface of the inner side of the cleaning vessel main body.

Therefore, the cleaning vessel has excellent durability to the ultrasonic waves, and also has excellent mechanical strength. In the above-described cleaning vessel, the cleaning vessel main body does not directly contact the cleaning liquid accommodated therein, and the silicon carbide sintered body directly contacts the cleaning liquid. The layer of silicon carbide sintered body has excellent corrosion resistance. Therefore, even if the cleaning liquid is a liquid such as acid, having a strong corrosiveness, no deterioration is caused in the layer of silicon carbide sintered body. As a result, the cleaning vessel has excellent corrosion resistance and can be used for a long life period.

According to the ninth aspect, in the cleaning vessel, the cleaning vessel main body has a heat resisting temperature of 120° C. or more. Accordingly, in this cleaning vessel, ultrasonic cleaning at a high temperature can be carried out.

According to the tenth aspect, in the cleaning vessel, the cleaning vessel main body has a high chemical resistance. In this cleaning vessel, even when the cleaning vessel main body accommodates therein a cleaning liquid such as acid having a strong corrosiveness, it has excellent corrosion resistance. As a result, the cleaning vessel has excellent durability and can be used for a long life period.

According to the eleventh aspect, in the cleaning vessel, the cleaning vessel main body is made of thermosetting resin. For this reason, there is no possibility that the cleaning vessel main body be deformed or the like due to heating at the time of ultrasonic cleaning. As a result, the cleaning vessel is easy to manufacture, and is excellent in durability, mechanical strength, and the like.

According to the twelfth aspect, in the cleaning vessel, the thermosetting resin is any one of polyvinyl chloride and polytetrafluoroethylene. For this reason, the cleaning vessel is easy to manufacture and is excellent in durability, mechanical strength, and corrosion resistance.

Another object of the present invention is to provide a silicon carbide sintered body of high density and high purity, which can be applied to components for semiconductor production apparatuses, components for electronic information equipment, and various structural components for vacuum devices and the like, and which can suitably be used as an ultrasonic resonance plate or an ultrasonic diaphragm, and when used as the ultrasonic resonance plate or ultrasonic diaphragm, which can be easily processed, and further which can be made thinner while maintaining sufficient mechanical strength.

The above-described object can be solved by the following means. That is, in accordance with a thirteenth aspect of the present invention, there is provided a silicon carbide sintered body which can propagate ultrasonic waves, wherein an acoustic velocity of ultrasonic waves propagated therethrough is 4000 to 20000 m/s.

In accordance with a fourteenth aspect of the present invention, there is provided a silicon carbide sintered body in which the acoustic velocity of ultrasonic waves propagated therethrough is 4000 to 11000 m/s, and the silicon carbide sintered body is used as an ultrasonic resonance plate.

In accordance with a fifteenth aspect of the present invention, there is provided a silicon carbide sintered body in which the acoustic velocity of ultrasonic waves propagated therethrough is higher than 11000 m/s and is 20000 m/s or less, and the silicon carbide sintered body is used as an ultrasonic diaphragm.

In accordance with a sixteenth aspect of the present invention, there is provided a silicon carbide sintered body in which the density of the silicon carbide sintered body is 2.9 g/cm$^3$ or greater.

In accordance with a seventeenth aspect of the present invention, there is provided a silicon carbide sintered body in which the total content of elements other than Si, C, O, N, halogen, and rare gas is 10 ppm or less.

In accordance with an eighteenth aspect of the present invention, there is provided a silicon carbide sintered body in which the volume resistivity of the silicon carbide sintered body is 1 Ω·cm or less.

In accordance with a nineteenth aspect of the present invention, there is provided a silicon carbide sintered body which is obtained by carrying out hot press for a mixture of silicon carbide powder and nonmetal based sintering additive at the temperature of 2000 to 2400° C. and at the pressure of 300 to 700 kgf/cm$^2$ in a non-oxidizing atmosphere.

In accordance with a twentieth aspect of the present invention, there is provided a silicon carbide sintered body which is obtained in such a manner that a mixture of silicon carbide powder and nonmetal based sintering additive is heated in a mold at the temperature of 80 to 300° C. for 5 to 60 minutes to form a molded body, and thereafter, the molded body is subjected to hot press at the temperature of 2000 to 2400° C. and at the pressure of 300 to 700 kgf/cm$^2$ in a non-oxidizing atmosphere.

DESCRIPTION OF THE PREFERRED EMBODIMENTS

Figure 1:
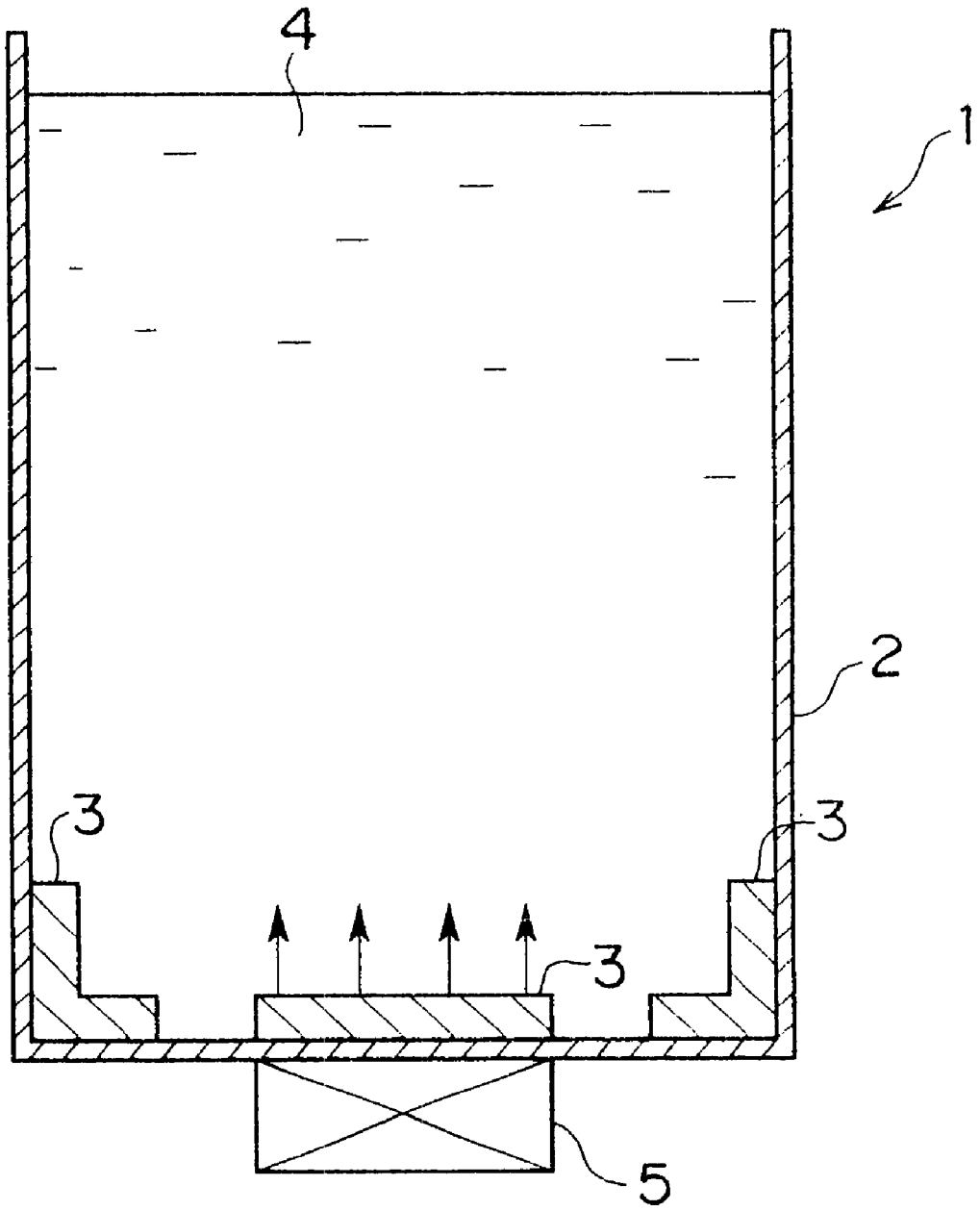
FIG. 1 is a cross sectional view which schematically shows a first example of a cleaning vessel according to the present invention.

A cleaning vessel of the present invention has a function of cleaning a material to be cleaned, by ultrasonic waves introduced into an interior thereof, and includes at least a cleaning vessel main body and a layer of silicon carbide sintered body.

[Cleaning Vessel Main Body]

The cleaning vessel main body is not particularly limited so long as it has a function of accommodating therein a material to be cleaned and a cleaning liquid. The shape, structure, and size of the cleaning vessel can be suitably selected in accordance with the purposes.

The above-described cleaning vessel main body may be formed in the shape of, for example, a cylinder which has a bottom at one end or each at both ends thereof and of which cross sectional configuration taken along a line parallel to the bottom surface is circular, rectangular, or the like. The cleaning vessel may be structured by using, for example, one kind of member, or two or more kinds of members. The size of the cleaning vessel main body can be suitably selected in accordance with, for example, the size of the material to be cleaned.

The thickness of the cleaning vessel main body is not particularly limited and can be suitably selected in accordance with the purposes.

The material of the cleaning vessel main body is not particularly limited so long as ultrasonic waves can be propagated therethrough, and can be suitably selected in accordance with the purposes. Examples thereof include metal, synthetic resin, and the like. The cleaning vessel main body may be formed of one kind of material, or may be formed of two or more kinds of materials.

Among the above-described materials, synthetic resin is preferably used. Particularly, synthetic resin having excellent resistance to heat (that is, synthetic resin having a heat resistance temperature of 120° C. or higher) is preferably used from the standpoint of maintaining durability by resisting overheat of the cleaning vessel main body at the time of ultrasonic cleaning. Further, synthetic resin which has excellent chemical resistance (that is, synthetic resin having a high resistance to chemicals) is preferably used from the standpoint of maintaining corrosion-resistance to the cleaning liquid. Moreover, thermosetting resin is preferably used from the standpoint of facilitating manufacturing of the cleaning vessel main body, maintaining resistance to heat, and the like.

In the present invention, the above-described thermosetting resin can be suitably selected among generally known examples. Polyvinyl chloride or polytetrafluoroethylene is preferably used from the standpoint of achieving excellent chemical resistance.

[Layer of Silicon Carbide Sintered Body used for Cleaning Vessel]

It is necessary that the layer of silicon carbide sintered body be formed, within the cleaning vessel main body, at least in a peripheral edge portion at the bottom of the cleaning vessel main body (that is, a bent portion and the vicinity thereof and in a portion into which the ultrasonic waves are introduced. In this case, deterioration or breakage of the cleaning vessel, which is caused by the ultrasonic waves, can be effectively restrained, and a long-lived cleaning vessel used for ultrasonic cleaning, having excellent durability, mechanical strength, and the like, is obtained.

The portion into which the ultrasonic waves are introduced, is generally provided near the center of the bottom of the cleaning vessel.

In the present invention, the layer of silicon carbide sintered body formed, within the cleaning vessel main body, continuously from the peripheral edge portion at the bottom of the cleaning vessel to the portion into which the ultrasonic waves are introduced, is preferable from the standpoint of obtaining a longer-lived cleaning vessel used for ultrasonic cleaning, having excellent durability, mechanical strength, and the like. Further, the layer of silicon carbide sintered body formed on an entire surface within the cleaning vessel main body, is particularly preferable from the standpoint of obtaining an extremely long-lived cleaning vessel used for ultrasonic cleaning, which has excellent durability, mechanical strength, and the like and also excellent corrosion-resistance to a cleaning liquid having a strong corrosiveness, for example, strong acid such as mixture of hydrofluoric acid and nitric acid, or strong alkali.

The above-described layer of silicon carbide sintered body is comprised of a silicon carbide sintered body through which ultrasonic waves are propagated, and has a function of propagating ultrasonic waves.

The density of the silicon carbide sintered body is preferably 2.9 g/cm$^3$ or more, and more preferably 3.0 g/cm$^3$ or more.

If the density is less than 2.9 g/cm$^3$, mechanical properties of the cleaning vessel, such as bending strength or breaking strength deteriorate, and the cleaning vessel is apt to be broken. As a result, particles may increase and the possibility at which the material to be cleaned is contaminated, may become higher. Further, cleaning efficiency may be decreased due to scattering of ultrasonic waves caused by pores.

The total content of impurities in the above-described silicon carbide sintered body, that is, the total content of elements other than Si, C, O, N, halogen, and rare gas, is preferably 10 ppm or less, and more preferably 5 ppm or less.

If the total content of elements other than Si, C, O, N, halogen, and rare gas exceeds 10 ppm, when acid or lye is used as the cleaning liquid, impurities or auxiliary components are dissolved from the silicon carbide sintered body into the cleaning liquid. As a result, there is a risk of the material to be cleaned being contaminated.

The volume resistivity of the above-described silicon carbide sintered body is preferably 1 Ω·cm or less, and more preferably 0.1 Ω·cm or less.

If the volume resistivity is greater than 1 Ω·cm, processing such as electric discharge machining is not easy to carry out and charging is apt to occur. Therefore, adhesion of particles caused by charging cannot sufficiently be restrained.

It is preferable that the silicon carbide sintered body can be heated by turning on electricity. In this case, the silicon carbide sintered body can be heated by turning on electricity, and the layer of silicon carbide sintered body can be controlled so as to be set at a temperature at which ultrasonic waves are easy to propagate. Further, advantageously, the temperature of the cleaning liquid can be controlled.

The silicon carbide sintered body formed in the peripheral edge portion at the bottom of the cleaning vessel within the cleaning vessel main body, preferably has a passage for a cooling medium. In this case, advantageously, the silicon carbide sintered body can be cooled merely by passing the cooling medium such as cooling water through the passage for a cooling medium, and the temperature of the layer of silicon carbide sintered body in an overheat state can be decreased so as to control the silicon carbide sintered body at a temperature at which ultrasonic waves are easy to propagate.

The thickness (b) of the silicon carbide sintered body is not particularly limited and can suitably be selected in accordance with the purposes. For example, when the silicon carbide sintered body is oscillated as an oscillator, the thickness given by the following expression is preferable.

That is, providing that a wavelength of introduced ultrasonic waves is λ, an acoustic velocity of the ultrasonic waves is υ, and a frequency of the ultrasonic waves is f, when the silicon carbide sintered body is oscillated a wavelength l/m, the preferable thickness of the silicon carbide sintered body is represented by the following expression:

$$\text{Thickness } (b)=(\lambda/m)n=(\upsilon/mf)n$$

(n represents an integer).

That is, preferably, the thickness (b) may be any integral times the half-wave length of introduced ultrasonic waves.

In this case, the layer of silicon carbide sintered body is oscillated at a half-wave length by the ultrasonic waves introduced therein so as not to interfere with vibration of the ultrasonic waves. As a result, energy reflectivity becomes zero and the ultrasonic waves can be efficiently propagated into the material to be cleaned. Thus, advantageously, the layer of silicon carbide sintered body has excellent cleaning efficiency.

[Ultrasonic Wave-Propagation Silicon Carbide Sintered Body]

The silicon carbide sintered body of the present invention can propagate ultrasonic waves therethrough, and the acoustic velocity of the propagated ultrasonic waves is in the range from 4000 to 20000 m/s.

If the acoustic velocity of the ultrasonic waves is less than 4000 m/s, when the silicon carbide sintered body is oscillated at a half-wave length by ultrasonic waves of 1 MHz, the thickness of the silicon carbide sintered body is 2 mm or less. In this case, sticking of the silicon carbide sintered body to the cleaning vessel becomes difficult and the strength thereof is not sufficiently obtained. As a result, application of the silicon carbide sintered body to an ultrasonic resonance plate or the like becomes difficult. On the other hand, if the acoustic velocity of the ultrasonic waves exceeds 20000 m/s, the thickness of the silicon carbide sintered body becomes greater than 10 mm. In this case, the production cost of the silicon carbide sintered body increases, and the silicon carbide sintered body is hard to vibrate or oscillate. Therefore, application thereof to an ultrasonic diaphragm or the like becomes difficult.

When the acoustic velocity of the propagated ultrasonic waves is in the range from 4000 to 11000 m/s, the silicon carbide sintered body can be suitably used as the ultrasonic resonance plate. Further, when the acoustic velocity exceeds 11000 m/s and is also equal to or less than 20000 m/s, the silicon carbide sintered body can be suitably used as the ultrasonic diaphragm.

The acoustic velocity of the ultrasonic waves can be measured by using a generally known ultrasonic pulse type dynamic-modulus-of-elasticity measuring device. Specifically, the acoustic velocity can be measured from a time in which ultrasonic waves are propagated when, for example, a transmitter and a receiver are respectively mounted at both sides of a sample to be measured and ultrasonic waves of 1 MHz are oscillated by an ultrasonic vibrator.

The density of the above-described silicon carbide sintered body is preferably 2.9 g/cm$^3$ or more, and more preferably 3.0 g/cm$^3$ or more.

If the density is less than 2.9 g/cm$^3$, the dynamic properties such as bending strength or breaking strength of the silicon carbide sintered body deteriorate, and the silicon carbide sintered body is apt to be broken. Further, ultrasonic waves are scattered within the sintered body by pores, and a desired strength of ultrasonic waves cannot be maintained.

The total content of impurities in the silicon carbide sintered body, that is, the total content of elements other than Si, C, O, N, halogen, and rare gas, is preferably 10 ppm or less, and more preferably 5 ppm or less.

If the total content of elements other than Si, C, O, N, halogen, and rare gas exceeds 10 ppm, when cleaning in an acid bath, impurities are dissolved into acid and the material to be cleaned may be contaminated.

The volume resistivity of the silicon carbide sintered body is preferably 1 Ω·cm or less, and more preferably 0.1 Ω·cm or less.

If the volume resistivity exceeds 1 Ω·cm, processing such as electric discharge machining is not easy to carry out and charging is apt to occur.

[Production of Silicon Carbide Sintered Body]

The silicon carbide sintered body of the present invention is produced by a process including a step in which a mixture of silicon carbide powder and nonmetal based sintering additive is sintered at the temperature in the range from 2000 to 2400° C.

The silicon carbide sintered body of the present invention can be produced by, for example, a process in which a mixture of silicon carbide powder and nonmetal based sintering additive is heated directly or within a mold at the temperature in the range from 100 to 150° C. for 5 to 60 minutes to thereby form a molded body, and thereafter, the molded body is sintered at the temperature in the range from 2000 to 2400° C. (this process may hereinafter be occasionally referred to as a "process for producing a silicon carbide sintered body").

The above-described silicon carbide powder is suitably obtained by a process in which a solid material obtained by homogeneously mixing a silicon source containing at least one kind of liquid silicon compound, a carbon source containing at least one kind of liquid organic compound, and a polymerization or cross-linking catalyst, is sintered in a non-oxidizing atmosphere (this process may hereinafter be occasionally referred to as a "process for producing silicon carbide powder").

The above-described silicon carbide sintered body may contain nitrogen.

In order that nitrogen be introduced into the silicon carbide sintered body, for example, at least one kind of nitrogen source may be added together with a silicon source and a carbon source in the above-described process for producing silicon carbide powder, or the nitrogen source may be added together with a nonmetal based sintering additive in the above-described process for making a silicon carbide sintered body from the silicon carbide powder.

The material used as the nitrogen source may be preferably a material which generates nitrogen upon being heated. Examples thereof include polyimide resin and precursors thereof, and various amine such as hexamethylenetetramine, ammonia, and triethylamine.

In the process for producing the silicon carbide powder, when the nitrogen source is added simultaneously with the silicon source, the amount of the nitrogen source to be added is in the range from 80 to 1000 μg with respect to 1 g of the silicon source. Further, in the process for producing the silicon carbide sintered body from silicon carbide powder, which will be described later, when the nitrogen source is added together with nonmetal based sintering additive, the amount of the nitrogen source to be added is in the range from 200 to 2000 μg with respect to 1 g of the nonmetal based sintering additive, and more preferably in the range from 1500 to 2000 μg.

Next, a description will be given of the silicon carbide powder, and the process for producing the same.

The silicon carbide powder may be α-type, β-type, amorphous type, or a mixture thereof. Particularly, the β-type silicon carbide powder is preferably used. In the silicon carbide sintered body of the present invention, the β-type silicon carbide preferably amounts to 70% or greater of all silicon carbide components, and more preferably 80% or greater. Further, the β-type silicon carbide may amount to 100% of all silicon carbide components. Accordingly, the amount of the β-type silicon carbide powder to be mixed is preferably 60% or greater of all silicon carbide powder of raw material, and more preferably 65% or greater.

The grade of the β-type silicon carbide powder is not particularly limited. For example, a β-type silicon carbide powder commonly available on the market can be used. It is preferable that the grain size of the silicon carbide powder be made smaller from the standpoint of achieving high densification. The grain size is preferably in the range from 0.01 to 10 μm, and more preferably in the range from 0.05 to 1 μm.

If the grain size is smaller than 0.01 μm, handling in processes for measurement, mixing, and the like may become difficult. Further, if the grain size is greater than 10 μm, the specific surface area thereof becomes small, namely, the contact area of adjacent powder grains becomes small, thereby making it difficult to achieve high densification.

In a preferred example of the silicon carbide powder, the grain size is 0.05 to 1 $\mu$m, the specific surface area is 5 $m^2/g$ or greater, free carbon is 1% or less, and the content of oxygen is 1% or less.

Further, the grain size distribution of silicon carbide powder to be used is not particularly limited. At the time of production of silicon carbide sintered body, silicon carbide powder having at least two maximal values can be used from the standpoint of improvement in packing density of the powder and reactivity of silicon carbide.

In order to obtain a high purity silicon carbide sintered body, it suffices that high purity silicon carbide powder be used as the silicon carbide powder of raw material.

The above-described high purity silicon carbide powder is suitably obtained, for example, by a production method including a sintering process in which a solid material formed by homogeneously mixing a silicon source containing at least one kind of liquid silicon compound, a carbon source containing at least one kind of liquid organic compound which generates carbon upon being heated, a polymerization or cross-linking catalyst, and a nitrogen source if required, is sintered in a non-oxidizing atmosphere.

As the silicon source containing a silicon compound (hereinafter occasionally referred to as a "silicon source"), a liquid silicon source and a solid silicon source can be used together, but at least one kind of silicon source needs be selected from a group consisting of liquid silicon sources.

Examples of liquid silicon sources include alkoxysilane (mono-, di-, tri-, tetra-) and polymers of tetraalkoxysilane.

Among alkoxysilanes, tetraalkoxysilane is preferably used. More specifically, methoxysilane, ethoxysilane, propoxysilane, butoxysilane, and the like can be suitably used. Among them, ethoxysilane is particularly preferably used from the standpoint of handling.

Preferable examples of the polymers of tetraalkoxysilane include low molecular weight polymers (oligomers) having a degree of polymerization of 2 to 15, and liquid polymers of silicic acid having a higher degree of polymerization.

As an example of solid material which can be used together is silicon oxide. The silicon oxide may be silicon monoxide (SiO), may be silica sol (a colloidal ultra-fine silica containing solution, which contains an OH or alkoxyl group therein), or may be silicon dioxide (silica gel, fine silica, quartz powder).

Among these silicon sources, an oligomer of tetraethoxysilane, or a mixture of an oligomer of tetraethoxysilane and an ultra-fine powder of silica is suitably used from the standpoint of homogeneity and handling. Further, the silicon sources used herein are preferably high purity substances and preferably contain impurities in an amount of 20 ppm or less, and more preferably 5 ppm or less, at an initial stage.

The carbon sources containing organic compound which generates carbon upon being heated (which may hereinafter be occasionally referred to as "carbon source") may be used singly in a liquid form or may be a mixture of liquid and solid forms. Preferably, the carbon source may be an organic compound having a high residual carbon ratio and polymerized or cross-linked by means of a catalytic action or heating. Examples of such organic compounds include monomers and prepolymers of phenol resin, furan resin, and other resins such as polyimide, polyurethane, and polyvinyl alcohol. Moreover, liquid compounds of cellulose, sucrose, pitch, tar, and the like can also be used. Among these, a resol-type phenol resin is particularly preferable. Further, the purity of the organic compound used as the carbon source can be controlled and selected appropriately in accordance with the purposes. However, when silicon carbide powder of high purity is required, an organic compound which contains metals each in an amount of less than 5 ppm is preferably used.

In production of the high purity silicon carbide powder, the ratio between carbon and silicon (which will be hereinafter abbreviated as "C/Si ratio") is defined by means of elemental analysis of a carbide intermediate obtained by carbonizing the mixture at 1000° C. Stoichiometrically, when the C/Si ratio is 3.0, there would be 0% free carbon in the produced silicon carbide. However, free carbon is actually generated at a lower C/Si ratio due to vaporization of the SiO gas generated simultaneously. It is important to determine the mixing ratio in advance so that the amount of free carbon in the produced silicon carbide powder becomes adequate for the purpose of producing a sintered body. In the case of sintering at around 1 atm and at 1600° C. or higher, generation of free carbon can normally be inhibited at a C/Si ratio of 2.0 to 2.5. Accordingly, this range can be advantageously used. When the C/Si ratio becomes higher than 2.5, the amount of free carbon increases remarkably. However, the free carbon has the effect of inhibiting the growth of grains, and therefore, the C/Si ratio may be appropriately selected in accordance with the purpose of grain formation. On the other hand, when sintering is carried out in an atmosphere of low pressure or high pressure, the C/Si ratio for obtaining pure silicon carbide will vary. In this case, the C/Si ratio is not necessarily limited to the above-described range.

The action of free carbon during sintering is very weak as compared with carbon derived from nonmetal based sintering additive applied onto a surface of silicon carbide powder, which will be described later. Therefore, it can be basically made negligible.

In order to obtain a solid material with the silicon source and the carbon source homogeneously mixed, when necessary, a mixed solid material is obtained by curing a mixture of the silicon source and the carbon source. The curing process may be carried out by means of cross-linking upon heating, by means of curing with a curing catalyst, or by means of an electron or radioactive beam. The curing catalyst used in the curing process may be selected appropriately in accordance with the type of the carbon source. When the carbon source is a phenol resin or a furan resin, the curing catalyst may be an acid such as toluen sulfonic acid, toluene carboxylic acid, acetic acid, oxalic acid, hydrochloric acid, sulfuric acid, or maleic acid, or an amine such as hexamine.

The above-described mixed solid material is heated to be carbonized when necessary. The carbonization by heating is achieved by heating the solid material in a non-oxidizing atmosphere of nitrogen, argon, or the like at a temperature of 800 to 1000° C. for 30 to 120 minutes.

The heat-carbonized mixed solid material is further heated in a non-oxidizing atmosphere of argon or the like at a temperature of 1350 to 2000° C., to thereby produce silicon carbide. The sintering temperature and time may be appropriately selected in accordance with a grain size or the like of silicon carbide powder to be obtained, and for more efficient production of silicon carbide, it is preferable that the sintering be carried out at a temperature of 1600 to 1900° C.

In order to produce silicon carbide powder of much higher purity, heating treatment is preferably carried out for 5 to 20 minutes at a temperature of 2000 to 2100° C. after the above-described sintering, and the impurities can be removed accordingly.

As a method for producing silicon carbide powder of particularly high purity, there is provided a method for producing a raw material powder, which is described in Japanese Patent Application Laid-Open (JP-A) No. 9-048605 (Patent Application No. 7-241856). Namely, this is a method which comprises: a silicon carbide producing step for producing silicon carbide powder by heating and sintering in a non-oxidizing atmosphere a homogenous mixture of a silicon source comprising at least one selected from tetraalkoxysilane and polymers of tetraalkoxysilane, each of which should be of high quality, and a carbon source comprising an organic compound of high purity which generates carbon upon being heated; and a post-treatment step in which heat treatment with the obtained silicon carbide powder being basically kept at a temperature from equal to or higher than 1700° C. to lower than 2000° C. and being heated at a temperature of 2000° C. to 2100° C. for 5 to 20 minutes is carried out at least once during the step. The silicon carbide powder obtained by the above-described production method has an impurity content of 0.5 ppm or less.

Next, a description will be given of a process for producing a silicon carbide sintered body from the above-described silicon carbide powder.

The silicon carbide sintered body is obtained by a production method comprising a step in which a mixture of silicon carbide powder, nonmetal based sintering additive, and a nitrogen source if required (which mixture may hereinafter be occasionally referred to as a mixture of silicon carbide powder) is sintered at a temperature of 2000 to 2400° C. (which may hereinafter be occasionally referred to as a sintering process).

The above-described nonmetal based sintering additive may be a substance which generates carbon upon being heated. Examples thereof include an organic compound which generates carbon upon being heated, and silicon carbide powder of which surface is coated with the organic compound (grain size: 0.01 to 1 $\mu$m or thereabouts), and the former one is preferably used from the standpoint of achieving effects.

Examples of the above-described organic compound which generates carbon upon being heated include coal-tar pitch, pitch tar, phenol resin, furan resin, epoxy resin, phenoxy resin, and various saccharides including monosaccharides such as glucose, oligosaccharides such as sucrose, and polysaccharides such as cellulose and starch, each having a high residual carbon ratio. In order to allow homogenous mixing with the silicon carbide powder, there are suitably used organic substances which are in the liquid form at room temperature, organic substances which are dissolved into solvents, or organic substances which soften or liquefy upon being heated such as thermoplastic or heat-melting materials. Among these substances, phenol resin, particularly, resol type phenol resin is preferably used from the standpoint of high strength of a molded body to be obtained.

It is considered that the above-described organic compound which generates carbon upon being heated, generates an inorganic carbon based compound such as carbon black or graphite, on a grain surface by being heated (or in the vicinity thereof) and effectively acts as sintering additive which efficiently removes a surface oxide film of silicon carbide during sintering. No effect can be obtained even if carbon black or graphite powder is added as the sintering additive.

When a mixture of the nonmetal based sintering additive and the silicon carbide powder is obtained, the nonmetal based sintering additive is preferably dissolved or dispersed in a solvent.

The above-described solvent may be a substance suitable for the compound used as the nonmetal based sintering additive. Specifically, a lower alcohol such as ethyl alcohol, ethyl ether, or acetone can be selected for phenol resin which is a suitable organic compound which generates carbon upon being heated. Further, the nonmetal based sintering additive and the solvent, each of which impurity content is low, are preferably used.

If the amount of the nonmetal based sintering additive to be added is too small, the density of a sintered body does not increase. Further, if the amount of the nonmetal based sintering additive is too large, free carbon contained in the sintered body increases so that high densification may not be achieved. Therefore, the amount of the nonmetal based sintering additive to be added is preferably 10% by weight or less in conversion of carbon to be generated, and more preferably 2 to 8% by weight although depending on the kind of used nonmetal based sintering additive. The amount of addition can be determined by quantifying in advance an amount of silica (silicon oxide) on the surface of silicon carbide powder using hydrofluoric acid and stoichiometrically calculating an amount sufficient for the reduction.

In the above-described silicon carbide sintered body, preferably, the total amount of carbon atoms derived from silicon carbide contained in the silicon carbide sintered body, and carbon atoms derived from the nonmetal based sintering additive is preferably greater than 30% by weight and is also less than or equal to 40% by weight.

If the content is 30% by weight or less, the ratio of impurities contained in the sintered body increases. If the content is greater than 40% by weight, the amount of carbon contained increases, and the density of a sintered body to be obtained decreases. Therefore, either case is not preferable due to deterioration of various characteristics, such as the strength or resistance to oxidation, of the sintered body.

In the silicon carbide sintered body, first, silicon carbide powder and nonmetal based sintering additive are homogeneously mixed together. As described above, phenol resin used as the nonmetal based sintering additive is dissolved in a solvent such as ethyl alcohol, and mixed sufficiently with silicon carbide powder. At this time, when a nitrogen source is added thereto, it can be added together with the nonmetal based sintering additive.

The mixing can be carried out by using a generally known mixing means, for example, a mixer or a planetary ball mill.

The mixing time is preferably 10 to 30 hours, and more preferably 16 to 24 hours. After sufficiently mixed, the solvent is removed at a temperature suitable for physical properties of the solvent, for example, at a temperature of 50 to 60° C. in a case of ethyl alcohol, and the mixture is evaporated to dryness. Thereafter, raw material powder of the mixture is obtained on sieve. It is necessary that a container of a ball mill and a ball are each made of synthetic resin having little metal from the standpoint of achieving high purification. Further, in drying the mixture, a granulating device such as a spray dryer may also be used.

The above-described sintering process is an essential step, that is, a step in which a molded body of the mixture of silicon carbide powder, or of silicon carbide powder obtained by a molding step, which will be described later, is placed within a mold at 2000 to 2400° C. and at a pressure of 300 to 700 kgf/cm$^2$ in a non-oxidizing atmosphere and subjected to hot press.

From the standpoint of the purity of a sintered body to be obtained, the above-described mold is preferably formed of graphite material in an entire or partial region thereof, or include a teflon sheet or the like interposed between the mold and the molded body, so as not cause the molded body and a metal portion of the mold to directly contact each other.

The above-described hot press can be carried out at the pressure of 300 to 700 kgf/cm$^2$. Particularly, when it is carried out at 400 kgf/cm$^2$ or greater, it is necessary to select hot press components used herein, for example, dies, punches, and the like, having excellent pressure tightness.

In the above-described sintering process, preferably, before carrying out hot press for producing the silicon carbide sintered body, impurities are sufficiently removed by effecting heating to rise a temperature under the following conditions, and the nonmetal based sintering additive is completely carbonized, and thereafter, the hot press provided under the above-described conditions is carried out.

In the above-described sintering process, the following two-stage temperature rising step is preferably carried out. First, an interior of a furnace is gradually heated in a vacuum from room temperature to 700° C. At this time, when it is difficult to control the temperature of a high temperature furnace, rising of temperature may be effected continuously to 700° C. Preferably, the interior of the furnace is set at a pressure of $10^{-4}$ torr and the temperature thereof is gradually increased from room temperature to 200° C., and is kept at the temperature for a fixed period of time. Thereafter, the temperature is further gradually increased and is heated to 700° C. Further, it is kept at 700° C. or thereabouts for a fixed period of time. In the first temperature rising step described above, elimination of adsorbed water or organic solvent is carried out, and nonmetal based sintering additive is carbonized by thermal decomposition. The time for which the temperature of the furnace is kept at 200° C. or thereabouts, or at 700° C. or thereabouts, is selected within a suitable range depending on the size of a sintered body. A determination as to whether each temperature keeping time suffices, can be made based on the point in time at which reduction in the degree of vacuum lessens to some degree. When heating is rapidly carried out at the above-described stage, removal of impurities or carbonization of nonmetal based sintering additive is not sufficiently carried out and there is a risk of cracks or air holes being formed in the molded body.

In the above-described sintering process, for example, in the case of 5 to 10 g of samples, the pressure is set to be $10^{-4}$ torr and the temperature is gradually increased from room temperature to 200° C., and kept at the temperature for 30 minutes. Thereafter, the temperature is gradually and continuously increased to 700° C. The time for which the temperature is increased from room temperature to 700° C. is 6 to 10 hours, and preferably 8 hours or thereabouts. Further, it is preferable that the temperature is kept at 700° C. or thereabouts for 2 to 5 hours.

The temperature of the furnace is further increased from 700 to 1500° C. and over 6 to 9 hours on the above-described condition, and further kept at 1500° C. for 1 to 5 hours. In this process, it is considered that reduction reaction of silicon dioxide or silicon oxide be conducted. It is important that the reduction reaction be sufficiently completed in order to remove oxygen bonding to silicon. The temperature keeping time at 1500° C. needs be maintained until generation of carbon monoxide, which is a by-product obtained by the reduction reaction, is completed, that is, until reduction in the degree of vacuum lessens and the degree of vacuum in the furnace is restored to a vacuum at 1300° C. or thereabouts, which temperature is set before starting of the reduction reaction. Due to the reduction reaction in the second temperature rising step, silicon dioxide is removed which adheres to the surface of silicon carbide powder to inhibit densification to thereby cause growth of large grains. Gas containing SiO and CO, which is generated during the reduction reaction, involves impurity elements, but such generated gas is continuously exhausted from a reactor furnace by a vacuum pump and removed. Therefore, preferably, the above-described temperature keeping needs be carried out sufficiently from the standpoint of achieving high purification.

After completion of the above-described temperature rising step, preferably, high pressure hot press is carried out. Sintering starts when the temperature exceeds 1500° C. In this case, application of pressure starts to 300 to 700 kgf/cm$^2$ or thereabouts, which value is set as the reference, so as to restrain abnormal growth of grains. Thereafter, inert gas is introduced into the furnace so that the interior thereof is made into a non-oxidizing atmosphere. The inert gas may be nitrogen or argon. Particularly, argon gas is preferably used from the standpoint of exhibiting non-reactivity even at a high temperature.

In the above-described hot press, after the interior of the furnace is made into a non-oxidizing atmosphere, heating and application of pressure are carried out so that the temperature thereof increases 2000 to 2400° C. and the pressure increases 300 to 700 kgf/cm$^2$. The pressure at the time of pressing can be selected based on the grain size of raw material powder. When the grain size of raw material powder is small, a preferred sintered body is obtained even if the pressure at the time of application of pressure is relatively small. Further, rising of the temperature from 1500° C. to 2000 to 2400° C., that is, the maximum temperature is carried out over 2 to 4 hours, but sintering rapidly progresses at 1850 to 1900° C. Then, the maximum temperature is kept for 1 to 3 hours and sintering is completed.

If the maximum temperature is less than 2000° C., high densification is not sufficiently achieved. If it exceeds 2400° C., there is a risk of powder or raw material of the molded body sublimating (decomposing). Either case is not preferable. Further, if the pressure is less than 500 kgf/cm$^2$, high densification is not sufficiently achieved. If it exceeds 700 kgf/cm$^2$, a mold such as a graphite mold is broken. Either case is not preferable from the standpoint of production efficiency.

In the above-described sintering process as well, from the standpoint of maintaining the purity of a sintered body to be obtained, graphite raw material of high purity is preferably used for a graphite mold, a heat insulator of a heating furnace, and the like, which are used herein. The graphite raw material may be that subjected to high purification. Specifically, graphite raw material subjected in advance to baking sufficiently at 2500° C. or more and generating no impurities at a sintering temperature is preferably used. Further, high purity inert gas having a low content of impurities is preferably used.

The silicon carbide sintered body having excellent characteristics is obtained by carrying out the above-described sintering process. From the standpoint of achieving high purification of a finally obtained sintered body, a molding process, which will be described below, may be carried out before the sintering process. The molding process carried out before the sintering process will be hereinafter described. The molding process is a process in which a mixture of silicon carbide powder is placed within a mold, and heated and pressurized at the temperature in the range from 80 to 300° C. for 5 to 60 minutes, thereby preparing in advance a molded body of the mixture of silicon carbide powder (which may hereinafter be occasionally referred to as a molded body). Preferably, the mixture of silicon carbide powder is packed in the mold densely to the utmost from the standpoint of achieving high density of a resulting silicon carbide sintered body. Due to the molding process, the mixture of silicon carbide powder of great bulk can be made compact in advance when a sample is packed in the mold for hot press. Therefore, a molded body having a large thickness is easy to manufacture by repetition of the molding process.

The mixture of silicon carbide powder is subjected to pressing at the heating temperature of 80 to 300° C., and preferably 120 to 140° C. in accordance with the characteristics of nonmetal based sintering additive and at the pressure of 60 to 100 kgf/cm$^2$ so that the density of packed raw material powder becomes 1.5 g/cm$^3$, and preferably 1.9 g/cm$^3$, and further kept in a pressurized state for 5 to 60 minutes, and preferably 20 to 40 minutes. As a result, a molded body comprised of the mixture of silicon carbide powder is obtained.

The density of the molded body is hard to become higher as an average grain size of the powder decreases. In order to achieve the high densification, preferably, a vibration packing process or the like is used when the powder is placed within the mold. Specifically, it is preferable that the density of the powder of which average grain size is 1 $\mu$m or thereabouts, is 1.8 g/cm$^3$ or greater, and the density of the powder of which average grain size is 0.5 $\mu$m or thereabouts, is 1.5 g/cm$^3$ or greater. If each density of the respective average grains sizes of the above-described powders is less than 1.5 g/cm$^3$ or 1.8 g/cm$^3$, high densification of a finally obtained sintered body becomes difficult.

The molded body can be subjected to cutting so as to be fit in a hot press mold to be used, prior to the subsequent sintering process. Preferably, the hot press process, that is, the sintering process is carried out in which the molded body of which surface is coated with nonmetal based sintering additive is placed in a mold at 2000 to 2400° C. and at the pressure of 300 to 700 kgf/cm$^2$ in a non-oxidizing atmosphere, thereby obtaining a silicon carbide sintered body of high density and high purity. At this time, so long as at least 500 ppm of nitrogen component is contained in the silicon carbide powder and/or together with the nonmetal based sintering additive, a silicon carbide sintered body of which volume resistivity is 1 Ω·cm or less, which contain about 150 ppm of nitrogen in the silicon carbide sintered body after sintering, is obtained.

If the sintering temperature is less than 2000° C., high densification (sintering) is not sufficiently achieved. Further, if it exceeds 2400° C., there is a risk of powder or raw material of molded body sublimating (decomposing), and nitrogen contained therein evaporates. Therefore, high densification and conductivity is not sufficiently obtained. Further, if the pressure exceeds 700 kgf/cm$^2$, the molded body such as a graphite mold is broken, which is not preferable from the standpoint of production efficiency.

Although the relation between an expressing mechanism of conductivity and a sintering temperature is not made clear, it has been understood that: if the sintering temperature is lower than 2000° C., a mechanism in which an electron passes in carbon phase derived from nonmetal based sintering additive, is dominant over a microstructure in the silicon carbide sintered body; and if the sintering temperature is 2000° C. or higher, a mechanism in which an electron passes across a grain boundary, is dominant. Moreover, it is also considered that in a process in which a resol type phenol resin, which is particularly preferable among the nonmetal based sintering additive, is carbonized, amorphous carbon or glass-like carbon is changed to graphite.

The silicon carbide sintered body obtained by the above-described production method has sufficiently high densification and the density thereof is 2.9 g/cm$^3$ or greater. If the density of the obtained sintered body is less than 2.9 g/cm$^3$, dynamic characteristics such as bending strength and breaking strength, or electrical material properties decrease. Further, particles increase and the degree of contamination deteriorates. Therefore, the above-described range of density is not preferable. Moreover, in a portion of the sintered body in which ultrasonic waves are propagated, ultrasonic waves are scattered by pores, which may result in reduction of cleaning efficiency. The density of the silicon carbide sintered body is more preferably 3.0 g/cm$^3$ or greater.

If the above-described silicon carbide sintered body is a porous body, heat resistance, oxidation resistance, chemical resistance, and mechanical strength thereof deteriorate, cleaning becomes difficult, micro crack is caused and micro fragments produced therefrom become contaminants, and gas permeability is caused. Thus, the physical properties of the sintered body deteriorate and application thereof is limited.

The total content of impurity elements in the silicon carbide sintered body is 10 ppm or less, and preferably 5 ppm or less. However, the above-described content of impurities based on chemical analysis is merely indicated as a reference value. Practically, the value varies depending on a state in which impurities are distributed uniformly or dispersed locally. Accordingly, those skilled in the art generally use commercial devices and evaluate, by various means, a degree at which a silicon carbide sintered body is contaminated by impurities in a predetermined heating condition. According to the production method comprising a sintering process in which solid material obtained by homogeneously mixing a liquid silicon compound, nonmetal based sintering additive, and a polymerization or cross-linking catalyst, is heated to be carbonized in a non-oxidizing atmosphere, and thereafter, sintered in a non-oxidizing atmosphere, the total content of impurity elements in the silicon carbide sintered body can be set to be 10 ppm or less. Further, silicon source and nonmetal based sintering additive, which are used in the step for producing the silicon carbide powder and in the step for producing the silicon carbide sintered body from the silicon carbide powder, and inert gas used for providing a non-oxidizing atmosphere, are each preferably set at a purity in which the total content of impurity elements is 10 ppm or less, and further, 500 ppm or less. However, so long as these densities are each set in an allowable range in the heating and sintering processes, the present invention is not limited to the same. The impurity elements mentioned herein include, substantially, elements other than Si, C, O, N, halogen, and rare gas.

A description will be hereinafter given of other suitable physical properties of the silicon carbide sintered body. For example, the bending strength of the silicon carbide sintered body at room temperature is 50.0 to 65.0 kgf/mm$^2$, the bending strength thereof at 1500° C. is 55.0 to 80.0 kgf/mm$^2$, Young's modulus is 3.5×104 to 4.5×104, Vickers hardness is 2000 kgf/mm$^2$ or greater, Poisson's ratio is 0.14 to 0.21, the coefficient of thermal expansion is $3.8\times10^{-6}$ to $4.2\times10^{-6}$ (° C.$^{-1}$), the coefficient of heat propagation is 150 W/m·k or greater, the specific heat is 0.15 to 0.18 cal/g·° C., the thermal shock resistance is 500 to 700 ΔT ° C.

When the silicon carbide sintered body contain nitrogen so as to obtain conductivity, the content of nitrogen is preferably 150 ppm, and more preferably 200 ppm. Further, nitrogen is preferably contained in a solid-solution form from the standpoint of stability.

In the present invention, a silicon carbide sintered body of desired shape is produced by processing the silicon carbide sintered body obtained as described above, for example, into a desired shape, and further polishing and cleaning, and the like. Further, for the above-described processing, electric discharge machining is particularly preferable.

So long as the heating condition indicated in the production method of the silicon carbide sintered body is satisfied, a production apparatus of the silicon carbide sintered layer is not particularly limited. The silicon carbide sintered layer can be produced by using a generally known heating furnace or a reactor so long as pressure tightness of a sintering mold is taken into consideration.

The above-described silicon carbide sintered layer may be directly joined with the cleaning vessel main body, or may be indirectly joined via an intermediate layer such as an adhesive layer.

The material to be cleaned, which is cleaned using the cleaning vessel of the present invention, is not particularly limited and can suitably be selected in accordance with the purposes. For example, the material to be cleaned may be compound semiconductors, silicon, semiconductor related members, electronic components, and the like.

The cleaning liquid accommodated in the cleaning vessel main body is not particularly limited so long as it can propagate ultrasonic waves therethrough. Examples of the cleaning liquid include water, acid, alkali, organic solvent, and mixed solvent thereof. In the case of the organic solvent, it is necessary to carry out indirect heating to prevent direct heating which causes fire. However, the silicon carbide sintered body has excellent heat conductivity, and therefore, the organic solvent can also be used suitably. In place of the above-described cleaning liquid, gaseous or solid matter can also be accommodated in the cleaning vessel. However, these matters are not preferable from the standpoint of cleaning efficiency.

The ultrasonic oscillator which introduces ultrasonic waves into the cleaning vessel, may be a generally known oscillator which can generate ultrasonic vibration.

The present invention can solve various problems in the above-described conventional example, and a long-lived cleaning vessel used for ultrasonic cleaning can be provided which is easily manufactured and is also easy to handle due to a simple structure, and which has excellent durability, mechanical strength, and corrosion resistance.

Further, according to the present invention, there can be provided a silicon carbide sintered body of high density and high purity, which can be applied to components for semiconductor production apparatuses, components for electronic information equipment, and various structural components for vacuum devices and the like, and which can suitably be used as an ultrasonic resonance plate or an ultrasonic diaphragm, and when used as the ultrasonic resonance plate or ultrasonic diaphragm, which can be easily processed, and further which can be made thinner while maintaining sufficient mechanical strength.

EXAMPLES

Examples of the present invention will be hereinafter described, but the present invention is not limited to the same.

Example 1

As illustrated in FIG. 1, a cleaning vessel 1 of Example 1 is comprised of a cleaning vessel main body 2 and a layer of silicon carbide sintered body 3.

The cleaning vessel main body 2 is made of polyvinyl chloride and has a cylindrical configuration having a circular bottom surface at one end thereof.

The layer of silicon carbide sintered body 3 is formed on a bottom-surface peripheral edge portion within the cleaning vessel main body 2. Further, an ultrasonic oscillator 5 is disposed at the bottom and outer side of the cleaning vessel main body 2, and the layer of silicon carbide sintered body 3 is formed at the bottom of the cleaning vessel main body 2 at a position corresponding to a portion in which the ultrasonic oscillator 5 is disposed.

The layer of silicon carbide sintered body 3 is comprised of a silicon carbide sintered body. The silicon carbide sintered body is obtained in such a manner as described below. That is, 6 g of amine containing resol-type phenol resin (residual carbon ratio after thermal decomposition is 50%) and 94 g of high purity β-silicon carbide powder of which average grain size is 2.0 $\mu$m and which has one grain distribution maximal value, were mixed together in 50 g of ethanol solvent by wet ball milling, and dried, to obtain a molded body having a cylindrical configuration of which diameter is 20 mm and thickness is 10 mm. The respective amounts of phenol resin and amine contained in the molded body were 6 wt % and 0.1 wt %. The molded body was sintered by hot press at the pressure of 700 kgf/cm$^2$ and at 2300° C. in an argon gas atmosphere for three hours to thereby produce the silicon carbide sintered body. The density of the obtained silicon carbide sintered body was 3.11 g/cm$^3$ and the volume resistivity thereof was 0.1 Ω·cm, and the total content of elements other than Si, C, O, N, halogen, and rare gas was 2 ppm.

The layer of silicon carbide sintered body 3 was formed by processing the obtained silicon carbide sintered body by electric discharge machining into a desired shape and fixing the same at a predetermined position in the cleaning vessel main body 2. The thickness of the layer of silicon carbide sintered body 3 was 6.4 mm.

Mixture of hydrofluoric acid and nitric acid (38% hydracid fluoride: 68% nitric acid: water=1:1:6 (volume ratio)) was placed, as a cleaning liquid, in the cleaning vessel main body 2.

Ultrasonic waves (frequency: 1 MHz) were oscillated by actuating the ultrasonic oscillator 5. That is, ultrasonic waves by which the thickness of the layer of silicon carbide sintered body 3 may be any integral times the half-wave length of oscillated ultrasonic waves, were oscillated.

Subsequently, the purity of the above-described cleaning liquid was measured by using an inductively coupled plasma mass spectrometer (ICP-MS). In this case, no increase in the purity of heavy metal was found and an amount of particles produced was small.

Further, silicon of which surface was forcedly contaminated with respective elements of K, Ca, Ti, Fe, Ni, Cu, and Zz at the rate of $1\times10^{12}$ atoms/cm$^2$, was placed, as the material to be cleaned, in the cleaning vessel main body 2. Ultrasonic cleaning for the material to be cleaned was carried out in such a manner that ultrasonic waves were oscillated in the same manner as described above. As a result, stains was removed from the material to be cleaned in a short period of time.

Moreover, even after the cleaning vessel 1 was used for 1000 hours, the interior of the cleaning vessel main body 2 was not deteriorated and no breakage or the like was found in the layer of silicon carbide sintered body 3.

Example 2

A cleaning vessel was formed as in Example 1 except that the thickness of the silicon carbide sintered body was 1 mm.

As a result, the time required for removal of stains from the material to be cleaned, was more than that of Example 1.

Example 3

Figure 2:
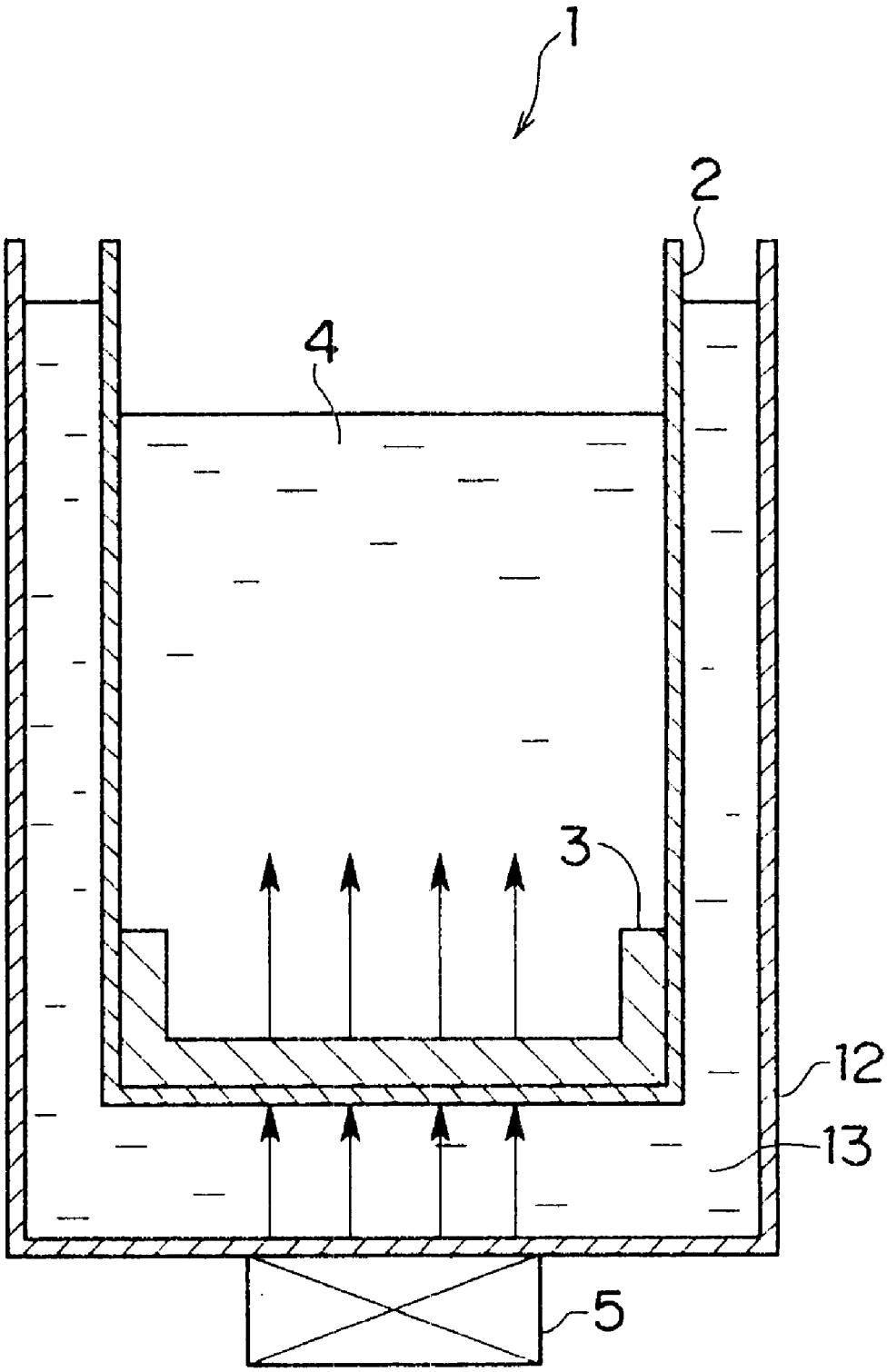
FIG. 2 is a cross sectional view which schematically shows a second example of a cleaning vessel according to the present invention.
Figure 3:
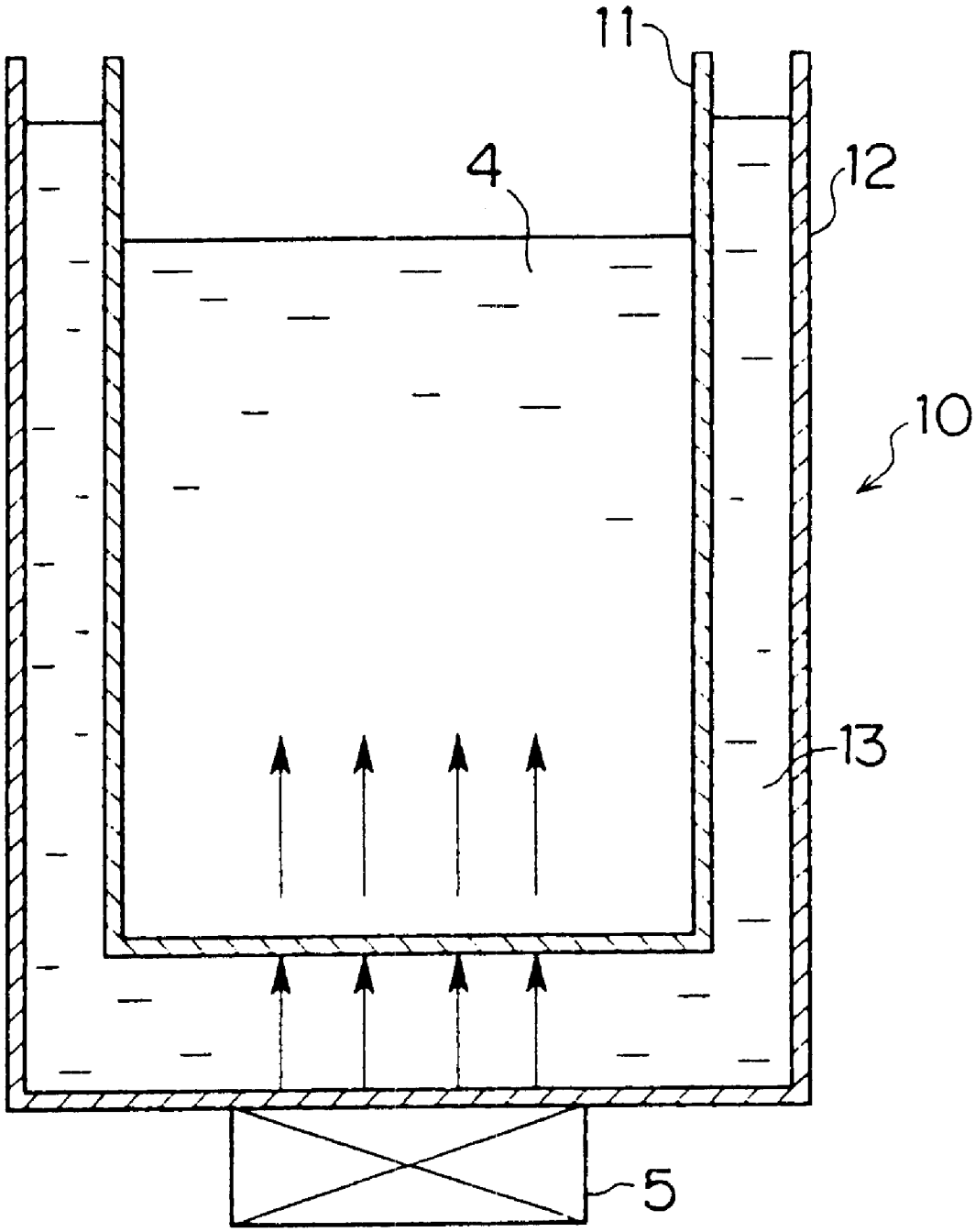
FIG. 3 is a cross sectional view which schematically shows a conventional cleaning vessel.

As shown in FIG. 2, the cleaning vessel 1 of Example 3 includes the cleaning vessel main body 2 and the layer of silicon carbide sintered body 3.

The cleaning vessel main body 2 is made of polyvinyl chloride and has a cylindrical configuration having a circular bottom surface at one end thereof.

The structure of Example 3 is different from that of Example 1 in that the layer of silicon carbide sintered body 3 is continuously formed on the bottom surface and peripheral surface adjacent thereto, of the cleaning vessel main body 2 at an inner side thereof. The thickness of the layer of silicon carbide sintered body 3 was 6.4 mm. The layer of silicon carbide sintered body 3 was formed of the silicon carbide sintered body used in Example 1.

Further, Example 3 is different from Example 1 in that the cleaning vessel main body 2 is disposed in a state of being accommodated within an external cleaning vessel 12 and water is accommodated, as an ultrasonic propagating medium 13, in a clearance between the cleaning vessel main body 2 and the external cleaning vessel 12.

Mixture of hydrofluoric acid and nitric acid (38% hydracid fluoride: 68% nitric acid: water=1:1:6 (volume ratio)) was placed, as a cleaning liquid, in the cleaning vessel main body 2.

Ultrasonic waves (frequency: 1 MHz) were oscillated by actuating the ultrasonic oscillator 5. That is, ultrasonic waves by which the thickness of the layer of silicon carbide sintered body 3 may be any integral times the half-wave length of oscillated ultrasonic waves, were oscillated.

Subsequently, the purity of the above-described cleaning liquid was measured by using an inductively coupled plasma mass spectrometer (ICP-MS). In this case, no increase in the purity of heavy metal was found and an amount of particles produced was small.

Further, silicon used in Example 1 was placed, as the material to be cleaned, in the cleaning vessel main body 2. Ultrasonic cleaning for the material to be cleaned was carried out in such a manner that ultrasonic waves were oscillated in the same manner as described above. As a result, stains was removed from the material to be cleaned in a short period of time.

Moreover, even after the cleaning vessel 1 was used for 1000 hours, the interior of the cleaning vessel main body 2 was not deteriorated and no breakage or the like was found in the layer of silicon carbide sintered body 3.

Comparative Example 1

A cleaning vessel 1 was formed as in Example 1 except that the cleaning vessel main body 2 was made from quartz and no layer of silicon carbide sintered body 3 was provided, and the above-described ultrasonic cleaning therefor was carried out.

Subsequently, the purity of the cleaning liquid was measured by using an inductively coupled plasma mass spectrometer (ICP-MS). As a result, 455 ppm of boron was detected and a large number of particles were produced.

Further, silicon used in Example 1 was placed, as the material to be cleaned, in the cleaning vessel main body 2. Ultrasonic cleaning for the material to be cleaned was carried out in such a manner that ultrasonic waves were oscillated in the same manner as described above. As a result, stains were not removed from the material to be cleaned in a short period of time.

Example 4

A silicon carbide sintered body was obtained in such a manner as described below. That is, 6 g of amine containing resol-type phenol resin (residual carbon ratio after thermal decomposition is 50%) and 94 g of high purity β-silicon carbide powder having an average grain size of 2.0 μm and having one grain distribution maximal value, were mixed together in 50 g of ethanol solvent by wet ball milling, and dried, to obtain a molded body having a cylindrical configuration of which diameter is 20 mm and thickness is 10 mm. The respective amounts of phenol resin and amine contained in the molded body were 6 wt % and 0.1 wt %. The molded body was sintered by hot press at the pressure of 700 kgf/cm$^2$ and at 2300° C. in an argon gas atmosphere for three hours to thereby produce the silicon carbide sintered body.

The acoustic velocity of ultrasonic waves to be propagated through the obtained silicon carbide sintered body was 11000 m/s. The density of the silicon carbide sintered body was 3.11 g/cm$^3$ and the volume resistivity thereof was 0.03 Ω·cm, and the total content of elements other than Si, C, O, N, halogen, and rare gas was 2 ppm.

The acoustic velocity of the propagated ultrasonic waves was measured, using a ultrasonic pulse type dynamic-modulus-of-elasticity measuring device (manufactured by Choonpa Kogyo Co., Ltd.; UVM-2 type), from a time in which ultrasonic waves are propagated when ultrasonic waves of 1 MHz are oscillated by an ultrasonic oscillator (quality of material: PTZ (that is, a mixture of lead titanate and lead zirconate)) with a transmitter and a receiver being attached to both sides of the silicon carbide sintered body.

When the silicon carbide sintered body was used as an ultrasonic resonance plate, the thickness thereof could be set to be 5.5 mm as required while maintaining sufficient mechanical strength. Further, this ultrasonic resonance plate was placed in a bath including mixture of hydrofluoric acid and nitric acid (10 liters) and oscillated by ultrasonic waves for one hour in the aggregate, and dissolution of impurities into the mixture of hydrofluoric acid and nitric acid was detected by using ICP-MS. As a result, no impurities was found.

Example 5

A silicon carbide sintered body was obtained as in Example 4. The obtained silicon carbide sintered body was evaluated in the same manner as in Example 4. The acoustic velocity of ultrasonic waves propagated through the silicon carbide sintered body was 12600 m/s. The density of the silicon carbide sintered body was 3.15 g/cm$^3$ and the volume resistivity thereof was 0.03 Ω·cm, and the total content of elements other than Si, C, O, N, halogen, and rare gas was approximately 2 ppm.

When the obtained silicon carbide sintered body having a thickness of 0.3 mm was used as an ultrasonic diaphragm in a state of being attached to an ultrasonic vibrator, ultrasonic waves of 850 kHz could be oscillated for a solution by an ultrasonic output of 1 MHz. Further, the ultrasonic diaphragm was placed in a bath including a mixture of hydrofluoric acid and nitric acid (10 liters) and oscillated by ultrasonic waves for one hour in the aggregate, and dissolution of impurities into the mixture of hydrofluoric acid and nitric acid was detected by using ICP-MS. As a result, no impurities was detected.

Comparative Example 2

A silicon carbide sintered body was obtained as in Example 4 except that 0.4% by weight of $B_4C$ was used as a sintering additive in place of the resol type phenol resin.

The obtained silicon carbide sintered body was evaluated in the same manner as in Example 4. The acoustic velocity of ultrasonic waves propagated through the silicon carbide sintered body was 10500 m/s. The density of the silicon carbide sintered body was 3.10 g/cm$^3$ and the volume resistivity thereof was 104 Ω·cm, and the total content of elements other than Si, C, O, N, halogen, and rare gas was approximately 40000 ppm.

When the silicon carbide sintered body was used as an ultrasonic resonance plate, the required thickness of the ultrasonic diaphragm was 5.25 mm. The ultrasonic resonance plate was placed in a bath including a mixture of hydrofluoric acid and nitric acid (10 liters) and oscillated by ultrasonic waves for one hour in the aggregate. Dissolution of impurities into the mixture of hydrofluoric acid and nitric acid was detected by using ICP-MS. As a result, 600 ppm of boron dissolved was detected and contamination with boron was observed.

What is claimed is:

1. A cleaning vessel for cleaning a material to be cleaned, by introducing therein ultrasonic waves, said cleaning vessel comprising a cleaning vessel main body in which the material to be cleaned is accommodated together with a cleaning liquid, and a layer of silicon carbide sintered body which propagates ultrasonic waves, wherein the layer of silicon carbide sintered body is formed at an inner side of the cleaning vessel main body at least on a bottom peripheral edge portion of the cleaning vessel main body and on a portion in which the ultrasonic waves are introduced.

2. A cleaning vessel according to claim 1, wherein the layer of silicon carbide sintered body is comprised of a silicon carbide sintered body of which density is 2.9 g/cm$^3$ or greater.

3. A cleaning vessel according to claim 1, wherein the layer of silicon carbide sintered body is comprised of a silicon carbide sintered body in which the total content of elements other than Si, C, O, N, halogen, and rare gas is 10 ppm or less.

4. A cleaning vessel according to claim 1, wherein the layer of silicon carbide sintered body is comprised of a silicon carbide sintered body of which volume resistivity is 1 Ω·cm or less.

5. A cleaning vessel according to claim 1, wherein the layer of silicon carbide sintered body is comprised of a silicon carbide sintered body which can be heated by turning on electricity.

6. A cleaning vessel according to claim 1, wherein the layer of silicon carbide sintered body formed on the bottom peripheral edge portion at the inner side of the cleaning vessel main body, has a passage for a cooling medium.

7. A cleaning vessel according to claim 1, wherein providing that a wavelength of introduced ultrasonic waves is λ, an acoustic velocity of the ultrasonic waves is υ, and a frequency of the ultrasonic waves is f, thickness (b) of the layer of silicon carbide sintered body when oscillated a wavelength l/m, is represented by the following expression:

$$(b)=(\lambda/m)n=(\upsilon/mf)n$$

(n represents an integer).

8. A cleaning vessel according to claim 1, wherein the layer of silicon carbide sintered body is formed on an entire surface at the inner side of the cleaning vessel main body.

9. A cleaning vessel according to claim 1, wherein the cleaning vessel main body has a heat resisting temperature of 120° C. or higher.

10. A cleaning vessel according to claim 1, wherein the cleaning vessel main body has high chemical resistance.

11. A cleaning vessel according to claim 1, wherein the cleaning vessel main body is made of thermosetting resin.

12. A cleaning vessel according to claim 11, wherein the thermosetting resin is any one of polyvinyl chloride and polytetrafluoroethylene.

* * * * *